US011790714B2

(12) United States Patent
Boston et al.

(10) Patent No.: US 11,790,714 B2
(45) Date of Patent: Oct. 17, 2023

(54) LOCKER APPARATUS, ASSOCIATED METHOD AND ASSOCIATED COMPUTER PROGRAM

(71) Applicant: Falcona Solutions Limited, Windsor (GB)

(72) Inventors: Jacob Boston, Windsor (GB); Tony Rainbow, Windsor (GB)

(73) Assignee: Falcona Solutions Limited, Windsor (GB)

( * ) Notice: Subject to any disclaimer, the term of this patent is extended or adjusted under 35 U.S.C. 154(b) by 0 days.

(21) Appl. No.: 17/726,907

(22) Filed: Apr. 22, 2022

(65) Prior Publication Data

US 2022/0375289 A1 Nov. 24, 2022

(30) Foreign Application Priority Data

May 20, 2021 (GB) ..... 2107235

(51) Int. Cl.
*G07C 9/00* (2020.01)
*G07C 9/22* (2020.01)

(52) U.S. Cl.
CPC ..... *G07C 9/00912* (2013.01); *G07C 9/00309* (2013.01); *G07C 9/22* (2020.01)

(58) Field of Classification Search
CPC ... G07C 9/00912; G07C 9/00309; G07C 9/22
See application file for complete search history.

(56) References Cited

U.S. PATENT DOCUMENTS

2015/0356801 A1 12/2015 Nitu et al.
2019/0102962 A1* 4/2019 Miller ..... G07C 9/00309
(Continued)

FOREIGN PATENT DOCUMENTS

WO 2017163018 A2 9/2017

OTHER PUBLICATIONS

Combined Search and Examination Report for GB Application No. 2107235.0, dated Nov. 23, 2021, 7 pages.

*Primary Examiner* — Nabil H Syed
(74) *Attorney, Agent, or Firm* — Han Santos, PLLC

(57) ABSTRACT

A locker apparatus, method and computer program are provided. The locker apparatus comprises: a plurality of lockers, wherein each locker is for storing a hand portable electronic device, and wherein each locker comprises a receiver configured to receive signals from a hand portable electronic device and comprises a locking mechanism for locking and unlocking the locker; user input circuitry configured to receive inputs from a user; a transmitter; at least one processor; and memory storing at least one computer program having computer program instructions that, when executed by the at least one processor, cause at least the following to be performed: in response to input being received at the user input circuitry identifying a user, identifying a hand portable electronic device for the user; causing the transmitter to a transmit a signal to the hand portable electronic device to cause the hand portable electronic device to output a signal for opening a locker; and if the signal output by the hand portable electronic device is received by one of the receivers, causing the locking mechanism of the locker comprising the receiver that received the signal output by the hand portable electronic device to unlock the locker.

17 Claims, 3 Drawing Sheets

(56) References Cited

U.S. PATENT DOCUMENTS

| | | | | |
|---|---|---|---|---|
| 2019/0172291 | A1* | 6/2019 | Naseath | G07C 9/00912 |
| 2020/0272997 | A1* | 8/2020 | Maki | G07C 9/00563 |
| 2023/0024810 | A1* | 1/2023 | Peters | G07F 17/005 |

* cited by examiner

LOCKER APPARATUS, ASSOCIATED METHOD AND ASSOCIATED COMPUTER PROGRAM

PRIORITY CLAIM

This application is a U.S. Nonprovisional Application claiming priority to GB Application No. 2107235.0 filed May 20, 2021, entitled "LOCKER APPARATUS, ASSOCIATED METHOD AND ASSOCIATED COMPUTER PROGRAM," which application is incorporated by reference herein in its entirety.

TECHNOLOGICAL FIELD

Embodiments of the present disclosure relate to a locker apparatus. Some relate to a locker apparatus for use in a logistics environment.

BACKGROUND

In a logistics environment, hand portable electronic devices might be used to manage and track parcels. The hand portable electronic devices might be stored in lockers when they are not in use.

BRIEF SUMMARY

According to various, but not necessarily all, embodiments there is provided a locker apparatus, comprising: a plurality of lockers, wherein each locker is for storing a hand portable electronic device, and wherein each locker comprises a receiver configured to receive signals from a hand portable electronic device and comprises a locking mechanism for locking and unlocking the locker; user input circuitry configured to receive inputs from a user; a transmitter; at least one processor; and memory storing at least one computer program having computer program instructions that, when executed by the at least one processor, cause at least the following to be performed: in response to input being received at the user input circuitry identifying a user, identifying a hand portable electronic device for the user; causing the transmitter to a transmit a signal to the hand portable electronic device to cause the hand portable electronic device to output a signal for opening a locker; and if the signal output by the hand portable electronic device is received by one of the receivers, causing the locking mechanism of the locker comprising the receiver that received the signal output by the hand portable electronic device to unlock the locker.

The receiver may be configured to receive wireless signals from a hand portable electronic device and the signal output by the hand portable electronic device may be a wireless signal.

The receiver may be configured to receive at least one of light signals and audio signals and the signal output by the hand portable electronic device may be a light signal or an audio signal.

The receiver may be configured to receive light signals and the signal output by the hand portable electronic device may be output by a display of the hand portable electronic device.

Each locker may comprise a housing that is substantially opaque.

The transmitter may be a radio frequency transmitter. The computer program instructions may be configured, when executed by the at least one processor, to cause the transmitter to transmit a radio frequency signal to the hand portable electronic device.

The user input circuitry may comprise at least one of a touch sensitive display, a keypad, an optical scanner, a biometric reader and a card reader.

Each locker may comprise a chamber for storing a hand portable apparatus. The locking mechanism may be for locking and unlocking the locker to prevent or provide user access to the chamber.

If a particular hand portable electronic device is assigned to the user in a database, identifying a hand portable electronic device for the user may comprise accessing the database to identify the particular hand portable electronic device assigned to the user. The signal transmitted by the transmitter may be transmitted to the particular hand portable electronic device assigned to the user.

If the user is not associated with any particular hand portable electronic device in a database, identifying a hand portable electronic device for the user may comprise assigning a particular hand portable electronic device to the user. The signal transmitted by the transmitter may be transmitted to the particular hand portable electronic device assigned to the user.

According to various, but not necessarily all, embodiments there is provided a method of controlling a locker apparatus comprising a plurality of lockers, each locker being for storing a hand portable electronic device, each locker comprising a receiver configured to receive signals from a hand portable electronic device and comprising a locking mechanism for locking and unlocking the locker, the method comprising: in response to input being received identifying a user, identifying a hand portable electronic device for the user; causing a transmitter to a transmit a signal to the hand portable electronic device to cause the hand portable electronic device to output a signal for opening a locker; and if the signal output by the hand portable electronic device is received by one of the receivers, causing the locking mechanism of the locker comprising the receiver that received the signal output by the hand portable electronic device to unlock the locker.

The signal output by the hand portable electronic device may be a wireless signal. The signal output by the hand portable electronic device may be a light signal or an audio signal. The signal output by the hand portable electronic device may be a light signal output by a display of the hand portable electronic device.

Each locker comprises a housing that is substantially opaque.

The transmitter may be a radio frequency transmitter which transmits a radio frequency signal to the hand portable electronic device.

The input identifying a user may be received via at least one of a touch sensitive display, a keypad, an optical scanner, a biometric reader and a card reader.

Each locker may comprise a chamber for storing a hand portable apparatus. The locking mechanism may be for locking and unlocking the locker to prevent or provide user access to the chamber.

If a particular hand portable electronic device is assigned to the user in a database, identifying a hand portable electronic device for the user may comprise accessing the database to identify the particular hand portable electronic device assigned to the user. The signal transmitted by the transmitter may be transmitted to the particular hand portable electronic device assigned to the user.

If the user is not associated with any particular hand portable electronic device in a database, identifying a hand portable electronic device for the user may comprise assigning a particular hand portable electronic device to the user. The signal transmitted by the transmitter may be transmitted to the particular hand portable electronic device assigned to the user.

According to various, but not necessarily all, embodiments there is provided at least one computer program comprising computer program instructions that, when executed by at least one processor, causes the method described above to be performed. The at least one computer program may be stored on one or more computer-readable media.

According to various, but not necessarily all, embodiments there is provided a locker apparatus, comprising: a plurality of lockers, wherein each locker is for storing a hand portable electronic device, and wherein each locker comprises at least one receiver configured to receive at least one of light signals or audio signals from a hand portable electronic device and comprises a locking mechanism for locking and unlocking the locker; user input circuitry configured to receive inputs from a user; a transmitter; at least one processor; and memory storing at least one computer program having computer program instructions that, when executed by the at least one processor, cause at least the following to be performed: in response to input being received at the user input circuitry identifying a user, identifying a hand portable electronic device for the user; causing the transmitter to a transmit a signal to the hand portable electronic device to cause the hand portable electronic device to output at least one of a light signal or an audio signal for opening a locker; and if the signal output by the hand portable electronic device is received by at least one of the receivers, located in one of the plurality of lockers, causing the locking mechanism of that locker to unlock that locker.

BRIEF DESCRIPTION

Some examples will now be described with reference to the accompanying drawings in which.

DETAILED DESCRIPTION

Figure 1:
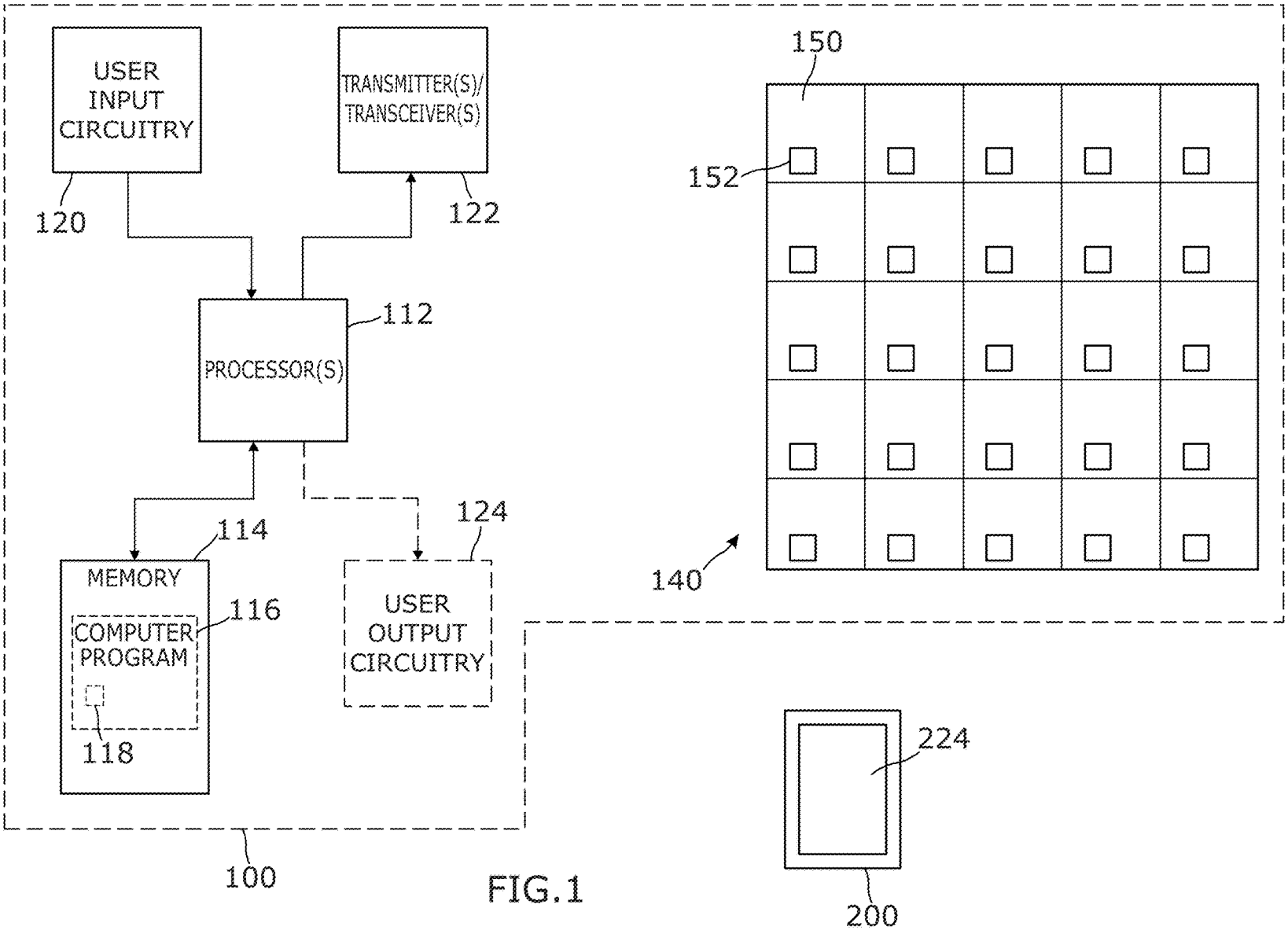
FIG. 1 illustrates a schematic of a locker apparatus and a hand portable electronic device.

FIG. 1 illustrates a schematic of a locker apparatus 100. The locker apparatus 100 may be used, for example, in a logistics environment to store hand portable electronic devices 200 and manage access to those hand portable electronic devices 200.

In the illustrated example, the locker apparatus 100 comprises electronic circuitry in the form of one or more processors 112, one or more memories 114, user input circuity 120 and one or more transmitters/transceivers 122. Optionally, the locker apparatus 100 may further comprise user output circuitry 124.

One or multiple processors 112 may be provided. A single processor 112 will be referenced hereinafter for clarity of explanation. The processor 112 may be a single core or multi-core processor. The processor 112 may also comprise an output interface via which data and/or commands are output by the processor 112 and an input interface via which data and/or commands are input to the processor 112.

The processor 112 is configured to read from and write to the one or more memories 114. The processor 112 is also configured to provide outputs to the transmitter(s)/transceiver(s) 122 and the user output circuitry 124 and receive inputs from the user input circuitry 120.

Although the memory 114 is illustrated as a single component/circuitry it may be implemented as one or more separate components/circuitry some or all of which may be integrated/removable and/or may provide permanent/semi-permanent/dynamic/cached storage. The memory 114 might include multiple memories that are located in different locations.

The memory 114 includes at least one non-transitory computer readable medium that stores a computer program 116 comprising computer program instructions (computer program code) 118, which control the operation of the apparatus 100 when loaded into the processor 112. The computer program instructions 118, of the computer program 116, provide the logic and routines that enables the apparatus 100 to perform part of the method illustrated in FIG. 3. The processor 112, by reading the memory 114, is able to load and execute the computer program 116.

The user input circuitry 120 is configured to receive inputs from users, and is configured to provide inputs to the processor 112 based on the inputs received from the users.

The input provided by a user at the user input circuitry 120 identifies that user. That is, the input enables the user to be identified in a database of users and distinguished from other users that are identified in the database. In some examples, an input might identify the user by her name. In other examples, an input might identify the user using other information, such as a personal identification number (PIN), a user identification number (e.g., an employee number), or biometric information.

In this regard, the user input circuitry 120 may comprise at least one of a touch sensitive display, a keypad, an optical scanner, a biometric reader and a card reader. For example, if a touch sensitive display and/or a keypad is provided, a user may be able to input alphanumeric characters which identify her. If an optical scanner is provided, a user may be able to identify herself by presenting an optical code, such as a quick response (QR) or a barcode to the optical reader (e.g., on the display of a device, a plastic card or a piece of paper). If a biometric reader is provided, the inputs that are provided comprise biometric information that enable the user to be identified, for instance via fingerprint recognition, face recognition, iris recognition and/or voice recognition. If a card reader is provided, the inputs are provided by presenting a card to the card reader which might, for instance, obtain information from the card by electrical, optical or magnetic means.

The transmitter(s)/transceiver(s) 122 receive inputs from, and are controlled by, the processor(s) 112. The transmitter(s)/transceiver(s) 122 are configured to transmit signals based on inputs provided by the processor 122. If at least one transceiver 122 is provided, the transceiver 122 is configured to provide inputs to the processor(s) 122 based on signals received at the transceiver 122.

The transmitter(s)/transceiver(s) 122 comprise at least one transmitter 122 that is for transmitting signals to hand portable electronic devices 200. The signals may be radio frequency signals, such as short-range radio frequency signals. A short-range radio signal might be a radio frequency signal having a range of 100 meters or less, for instance. For example, the short-range radio frequency radio signals might be Bluetooth® signals.

The user output circuitry 124 receives inputs from, and is controlled by, the processor 112. The user output circuitry 124 is configured to output information to a user. The user output circuitry 124 may, for example, comprise one or more a display and/or a loudspeaker. At least some of the user output circuitry 124 might be combined with at least some of the user input circuitry 120, for example if a touch sensitive display is provided.

The elements 112, 114, 120, 120 and 122 are operationally connected. Any number of intervening elements may exist between them (including no intervening elements).

The locker apparatus 100 comprises a plurality of lockers 140. At least some of the processor(s) 112, the memory 114, the user input circuitry 120, the transmitter/transceiver(s) 122 and the user output circuitry 124 are positioned locally to the lockers. In some examples, some aspects processing and storage carried out by the processor(s) 112 and the memory 114 might be carried out at a one or more locations remote from the lockers 140. In this regard, the transceivers 122 might comprise at least one transceiver 122 for communicating with the remote processor(s) 112 and/or remote memory 114 via one or more networks such as the internet. These communications may include wired and/or wireless communications.

At least some of the lockers 140 are for storing a hand portable electronic device 200. That is, the lockers 140 are shaped and sized to accommodate an electronic device 200 that may be held and transported by a single hand of a user. A hand portable electronic device 200 is illustrated in FIG. 1 which comprises a display 224.

Each individual locker 150 comprises a receiver 152 and a locking mechanism (not shown in FIG. 1). FIG. 1 illustrates twenty-five lockers 140 in a 5×5 grid. In other examples, more or fewer lockers might be provided than those illustrated in FIG. 1. Furthermore, the manner in which the lockers 140 are arranged relative to each other might be different from that illustrated in FIG. 1.

Figure 2A:
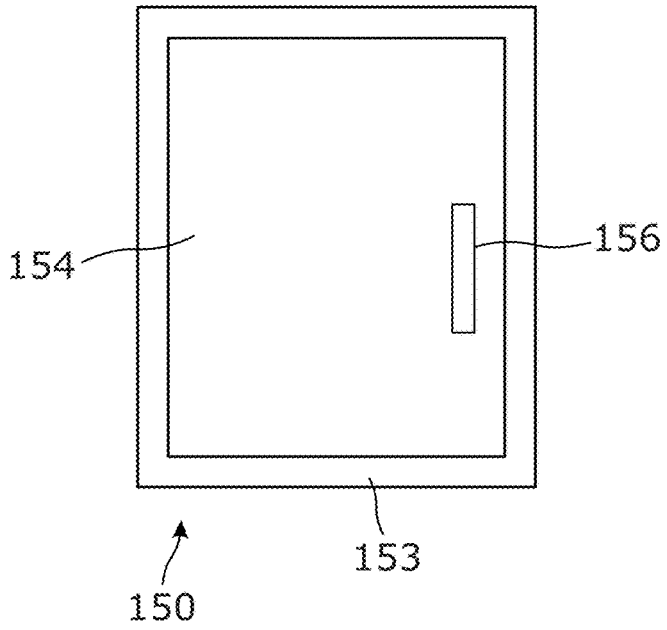
FIG. 2A illustrates an example of a locker of the locker apparatus in a locked state.
Figure 2B:
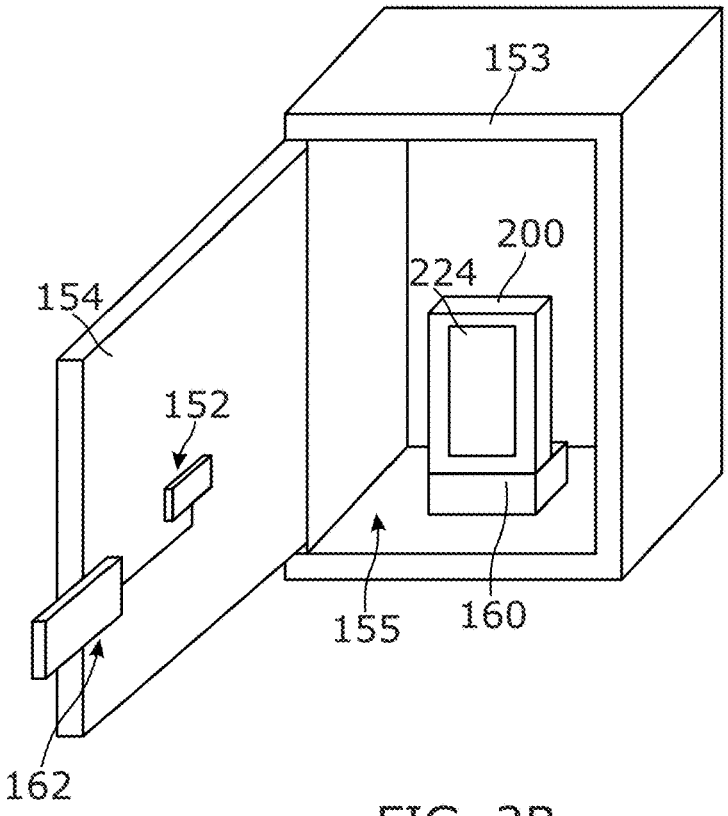
FIG. 2B illustrates the locker of FIG. 2A in an unlocked state.

FIG. 2A illustrates an example of an individual locker 150 in a locked state. FIG. 2B illustrates the locker 150 in an unlocked state. The locker comprises a housing 153. The housing 153 comprises a door 154 having a handle 156. FIG. 2A illustrates the door 154 in a closed position. FIG. 2B illustrates the door in an open position.

The locker 150 comprises a chamber 155 in which a hand portable electronic device may be stored. The housing 153 defines the chamber. The locker 150 comprises a support 160 for supporting a hand portable electronic device 200. The support 160 may hold the hand portable electronic device 200 in a particular position within the chamber 155. The support 160 may, for example, be a cradle for the hand portable electronic device 200. The support 160 may comprise an electrical connector for supplying power to the hand portable electronic device 200 when the electrical connector is electrically connected to the hand portable electronic device 200. The electrical connector of the support 160 may power and/or charge the hand portable electronic device 200.

The receiver 152 of each locker 150 is configured to receive signals from a hand portable electronic device 200. In the example illustrated in FIG. 2B, the receiver 152 is located on the inside of the door 154 of the locker 150. This might not be the case in other examples, however. For instance, the receiver 152 might be located within the chamber 155 when the door 154 is open.

The receiver 152 may be configured to receive a wireless signal from the hand portable electronic device 200. The receiver 152 may be positioned to receive that wireless signal from the hand portable electronic device 200, when the hand portable electronic device 200 is located in the chamber 155 of the locker 150. For instance, in some embodiments, the wireless signal may be a (visible) light signal and the receiver 152 might be or comprise an optical receiver, such as a photodiode. The light signal might, for example, be output by the display 224 of the hand portable electronic device 200. In such embodiments, the housing 153 might be substantially opaque, such that little or no light enters the chamber 155 when the locker 150 is closed.

In other examples, the wireless signal may be an audio signal and the receiver 152 may comprise a microphone for receiving such an audio signal. In these embodiments, the housing 153 might be sound-proofed, or at least comprise some material having sound-damping or sound absorption properties to mitigate the entry of sound waves into the chamber 155 when the locker 150 is closed.

The locker 150 comprises a locking mechanism 162. The locking mechanism 162 is configured to lock the locker 150 to prevent user access to the chamber 155, and configured to unlock the locker 150 to provide user access to the chamber 155.

The locking mechanism 162 is operationally connected to the receiver 152. If the receiver 152 receives a particular signal (e.g., a particular wireless signal such as a light signal or an audio signal) from a hand portable electronic device 200, it may cause the locking mechanism 162 to transition from a locked configuration to an unlocked configuration. The receiver 152 is operationally connected to the locking mechanism 162. For instance, it may be connected to the locking mechanism 162 via a wired connection or a wireless connection. It may be directly connected to the locking mechanism 162, or indirectly connected to the locking mechanism 162 via one or more other elements (e.g., the processor 112).

The locking mechanism 162 may be configured to automatically open the locker 150 when it is transitioned from an unlocked state to a locked state. For example, the locking mechanism 162 might cause the door 153 to open automatically.

The locking mechanism 162 may be configured to automatically lock the locker 150 when it is transitioned from its open state to its closed state.

The locker 150 may be simultaneously in the locked state and the closed state, simultaneously in the unlocked state and the closed state, and simultaneously in the open state and the unlocked state, depending upon how the locking mechanism 153 functions.

The locker 150 is considered to be in its open state when chamber 155 is accessible to a user via an opening, such as the opening created when opening the door 154. In other embodiments, the locker 150 might not comprise a door 154. It could instead comprise a drawer, for instance. The opening might be created by opening the drawer.

Figure 3:
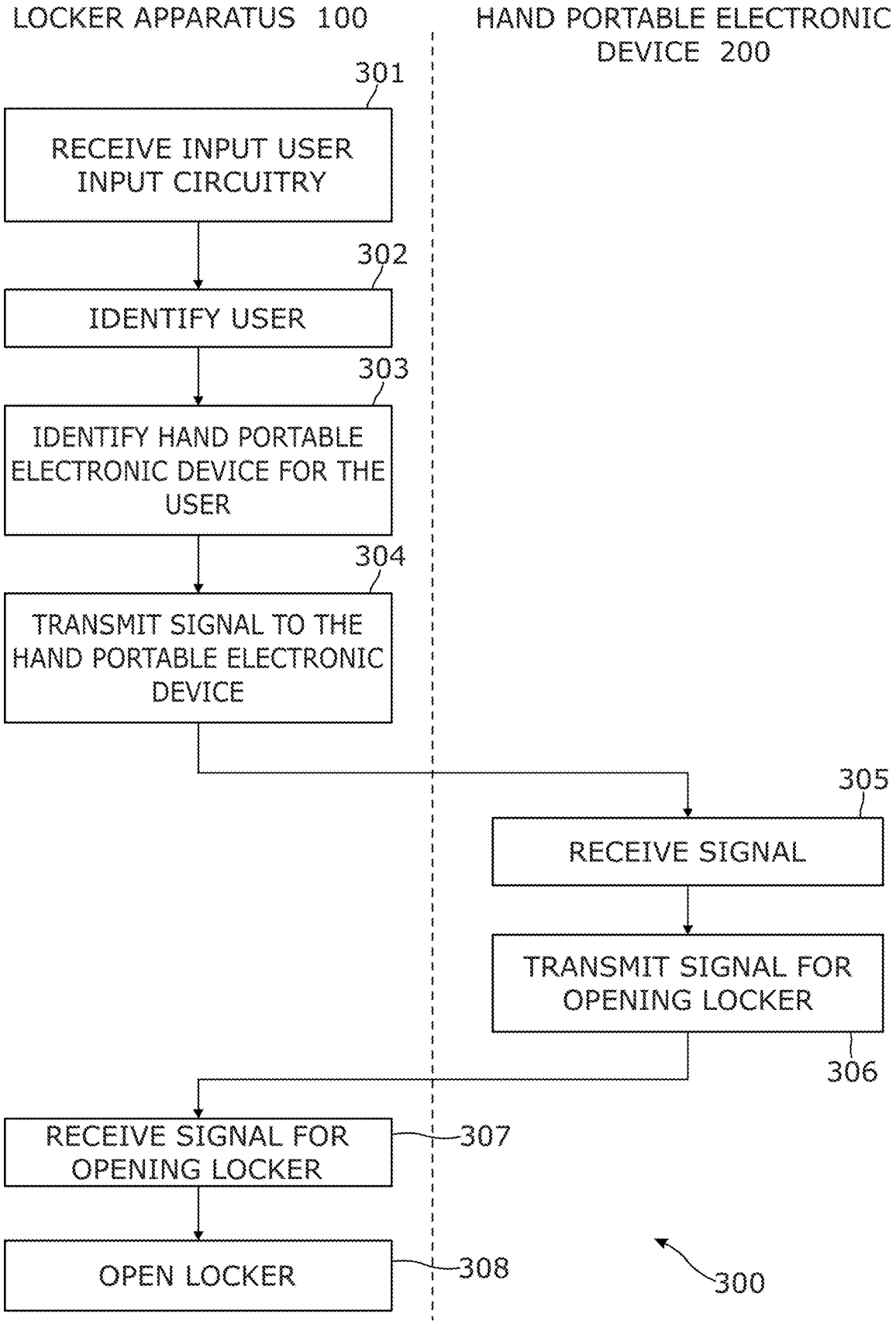
FIG. 3 illustrates a flow chart of a method.

FIG. 3 illustrates a flow chart of a method 300. The left-hand side of the flow chart illustrates operations carried out by the locker apparatus 100. The right-hand side of the flow chart illustrates operations carried out by the hand portable electronic device 200.

In this method, a user wishes to obtain a hand portable electronic device 200 that is stored in one of the plurality of lockers 150 in order to carry out tasks in a logistics environment. For example, the user may wish to use a hand portable electronic device 200 to scan parcels into a warehouse or scan parcels out of a warehouse.

Initially, a user travels to the locker apparatus 100 and, at block 301 in FIG. 3, provides inputs into the user input circuitry 120. As explained above, the input may be provided via at least one of a touch sensitive display, a keypad, an optical scanner, a biometric reader and a card reader.

At block 302 in FIG. 3, the user is identified based on the inputs provided in block 301. The inputs provided in block 301 enable the user to be identified in a database of users and distinguished from other users that are identified in the database. The database may be stored in the memory 114. The database may be stored locally to the lockers 140 or remotely from the lockers 140.

As explained above, the input provided by the user may the comprise an identifier that may take a number of different forms, such as the user's name, the user's employee number, a PIN assigned to the user or biometric information of the user.

In block 303 in FIG. 3, the processor 112 identifies a hand portable electronic device 200 for the user. In some examples, a particular hand portable electronic device has already been assigned to the user prior to the input being provided by the user at block 301. In these examples, the processor may access the database to determine in which the user has been identified in order to identify which hand portable electronic device 200 has already been assigned to the user. The database may include an association between the identified user and the hand portable electronic device 200 assigned to the user. The hand portable electronic device 200 may, for example, have a unique identifier such as a media control address (MAC address). The association in the database may associate the user identifier with the hand portable electronic device identifier. Thus, when identifying the user from the input provided at the user input circuitry in block 301, the processor 112 use the association in the database to identify the hand portable electronic device 200 assigned to the user in block 303.

In other examples, no hand portable electronic device 200 has been pre-assigned to the user prior to the user providing inputs at block 301. In these examples, it might be that hand portable electronic devices 200 are not assigned to particular users on a long-term basis, and are instead assigned to users on "per use" basis.

In these examples, in block 303, the database stored in the memory 114 might provide a list a database of available hand portable electronic devices 200 (and their identifiers) and the processor 112 may assign one of those hand portable electronic devices 200 to the user by associating the user identifier with the hand portable electronic device identifier in the database.

In block 304 in FIG. 3, the processor 112 controls the transmitter 122 to transmit a signal to the hand portable electronic device 200 assigned to the user. As mentioned above, the signal may, for example, be a radio frequency signal such as a short-range radio frequency signal. The signal may include data that indicates that it is addressed to the hand portable electronic device identified in block 303. For example, it may include the hand portable electronic device identifier that was determined in block 303. The signal transmitted by the transmitter 122 may be a broadcast signal, for instance.

A plurality of hand portable electronic devices 200 are stored in the plurality of lockers 140. Each hand portable electronic device 200 receives the signal and determines if it is the intended recipient of the signal by comparing the hand portable electronic device identifier in the signal with its own identifier. If a hand portable electronic device 200 determines that the two identifiers match, it is the intended recipient of the signal. In block 305 of FIG. 3, the hand portable electronic device 200 having an identifier that matches the identifier in the signal receives the signal transmitted by the transmitter 122.

The hand portable electronic device 200 having the matching identifier is positioned in a chamber 155 of one of the lockers 140, for example as illustrated in FIG. 2B and described above. However, the locker 150 in which the hand portable electronic device 200 is currently stored is in a closed and locked state, as illustrated in FIG. 2A.

In block 306 of FIG. 3, the hand portable electronic device having the matching identifier responds to reception of the signal in block 305 by transmitting a signal for opening the locker 150. The signal that is transmitted by the hand portable electronic device 200 may, for example, be a wireless signal that includes or is a light signal or an audio signal, as explained above. In some examples, the signal transmitted by the hand portable electronic device 200 is a light signal transmitted by the display 224 of the hand portable electronic device 200. For instance, the signal may be encoded with a code by causing the display 224 to flash/illuminate in accordance with a particular sequence, or the display 224 might display a particular pattern of symbols or colors.

In block 307 in FIG. 3, the receiver 152 of the locker 150 in which the hand portable electronic device 200 is located receives the signal transmitted by the hand portable electronic device 200. The information in the signal is provided by the receiver 152 to the one or more processors 112. As explained above, the processor(s) 112 might comprise multiple processors or a single (e.g., central) processor. In this regard, the signal may be processed locally in a processor 112 in the locker 150 or in a processor that is remote from the locker 150 (and possibly remote from the locker apparatus 100).

If the signal that has been received by the receiver 152 matches a predefined unlocking signal (e.g. that is stored in the memory 114), the processor 112 controls the locking mechanism 162 of the locker 150 to unlock the locker 150 in block 308 in FIG. 3. As explained above, the locking mechanism 162 might simultaneously unlock the locker 150 and open the locker 150, for instance by opening the door 154. Alternatively, the locking mechanism 162 may unlock the locker but the locker may remain in a closed state. The user is then able to transition the locker from its closed state to its open state manually (e.g., using the handle 156). Once the locker 150 has been unlocked and opened, the user may retrieve the hand portable electronic device 200 and use it in the logistics environment.

In some examples, the processor 112 may control the user output circuitry 124 to indicate to the user which locker 150 from the plurality of lockers 140 has been unlocked to enable the portable electronic device 200 to be received. In this regard, each of the receivers 152 may have a (unique) identifier. When a receiver 152 communicates with the processor 112 to provide it with the code that has been received from a hand portable electronic device 200 it may also provide its identifier, which enables the processor 112 to determine which locker is to be opened if the code provided by the receiver 152 is determined to be valid. Each locker may have an identifier that is provided on the exterior of its housing (e.g., on the door 154). An association may be stored in the database in the memory 114 between the receiver identifier and the identifier provided on the outside of the housing 153 of the locker 150 (which may, for example, be a locker number). The processor 112 may control the user output circuitry 124 (which may, for example, include a display and/or a loudspeaker) to convey to the user which locker that is being unlocked (e.g., by displaying the locker identifier/number on the display).

When the user has finished using her hand portable electronic device 200, she may place it into any of the plurality of lockers 140 for storage. The hand portable electronic device 200 can then be retrieved by using the method illustrated in FIG. 3 and described above.

Embodiments of the present invention advantageously provide a more efficient method and apparatus for storing and retrieving hand portable electronic devices 200. In particular, those skilled in the art will appreciate that a particular advantage is that it is not necessary for users to place particular hand portable electronic devices 200 into particular lockers 140. That is, it is not necessary for each user to be assigned a particular locker 150 in which she places her hand portable electronic device 200 when it is not in use. This is because the hand portable electronic device 200 is used to unlock the locker 150, and so the hand portable electronic device 200 can be placed into any one of the plurality of lockers 140. This avoids problems that might occur in alternative system where users are required to place their hand portable electronic devices in particular lockers that are assigned to them, and some of the users accidentally place their hand portable electronic devices into the wrong lockers.

References to 'computer-readable medium', 'computer program product', or a 'computer', 'processor' etc. should be understood to encompass not only computers having different architectures such as single/multi-processor architectures and sequential (Von Neumann)/parallel architectures but also specialized circuits such as field-programmable gate arrays (FPGA), application specific circuits (ASIC), signal processing devices and other processing circuitry. References to computer program, instructions, code etc. should be understood to encompass software for a programmable processor or firmware such as, for example, the programmable content of a hardware device whether instructions for a processor, or configuration settings for a fixed-function device, gate array or programmable logic device etc.

The blocks illustrated in the FIG. 3 may represent steps in a method and/or sections of code in the computer program 116. The illustration of a particular order to the blocks does not necessarily imply that there is a required or preferred order for the blocks and the order and arrangement of the block may be varied.

Where a structural feature has been described, it may be replaced by means for performing one or more of the functions of the structural feature whether that function or those functions are explicitly or implicitly described.

The term 'comprise' is used in this document with an inclusive not an exclusive meaning. That is any reference to X comprising Y indicates that X may comprise only one Y or may comprise more than one Y. If it is intended to use 'comprise' with an exclusive meaning then it will be made clear in the context by referring to "comprising merely one . . . " or by using "consisting".

In this description, reference has been made to various examples. The description of features or functions in relation to an example indicates that those features or functions are present in that example. The use of the term 'example' or 'for example' or 'can' or 'may' in the text denotes, whether explicitly stated or not, that such features or functions are present in at least the described example, whether described as an example or not, and that they can be, but are not necessarily, present in some of or all other examples.

Although examples have been described in the preceding paragraphs with reference to various examples, it should be appreciated that modifications to the examples given can be made without departing from the scope of the claims. For example, if a light signal is output by the hand portable electronic device 200, it might be output by one or more (individual) light emitting diodes rather than a display of the hand portable electronic device 200. Some references are made to features provided using a "database" above; those features may also be provided by referencing multiple databases or a single database.

Although functions have been described with reference to certain features, those functions may be performable by other features whether described or not.

Although features have been described with reference to certain examples, those features may also be present in other examples whether described or not.

The term 'a' or 'the' is used in this document with an inclusive not an exclusive meaning. That is any reference to X comprising a/the Y indicates that X may comprise only one Y or may comprise more than one Y unless the context clearly indicates the contrary. If it is intended to use 'a' or 'the' with an exclusive meaning then it will be made clear in the context. In some circumstances the use of 'at least one' or 'one or more' may be used to emphasis an inclusive meaning but the absence of these terms should not be taken to infer any exclusive meaning.

The presence of a feature (or combination of features) in a claim is a reference to that feature or (combination of features) itself and also to features that achieve substantially the same technical effect (equivalent features). The equivalent features include, for example, features that are variants and achieve substantially the same result in substantially the same way. The equivalent features include, for example, features that perform substantially the same function, in substantially the same way to achieve substantially the same result.

In this description, reference has been made to various examples using adjectives or adjectival phrases to describe characteristics of the examples. Such a description of a characteristic in relation to an example indicates that the characteristic is present in some examples exactly as described and is present in other examples substantially as described.

The invention claimed is:

1. A locker apparatus, comprising:

a plurality of lockers, wherein each locker is for storing a hand portable electronic device, and wherein each locker comprises a receiver configured to receive at least one of light signals or audio signals from a corresponding hand portable electronic device stored in one of the plurality of lockers and comprises a locking mechanism for locking and unlocking each locker;

user input circuitry configured to receive inputs from a user;

a transmitter;

at least one processor; and memory storing at least one computer program having computer program instructions that, when executed by the at least one processor, cause at least the following to be performed:

in response to input being received at the user input circuitry identifying a user, identifying a hand portable electronic device stored in a locker of the plurality of lockers for the user;

causing the transmitter to a transmit a signal to the hand portable electronic device to cause the hand portable electronic device to output a signal for opening the locker; and if the signal output by the hand portable electronic device is received by one of the receivers that is configured to receive at least one of light signals or audio signals, causing the locking mechanism of the locker comprising the receiver that received the signal output by the hand portable electronic device to unlock the locker.

2. The locker apparatus of claim 1, wherein the receiver is configured to receive the light signals, and the signal output by the hand portable electronic device is output by a display of the hand portable electronic device.

3. The locker apparatus of claim 1, wherein each locker comprises a housing that is substantially opaque.

4. The locker apparatus of claim 1, wherein the transmitter is a radio frequency transmitter and the computer program instructions are configured, when executed by the at least one processor, to cause the transmitter to transmit a radio frequency signal to the hand portable electronic device.

5. The locker apparatus of claim 1, wherein the user input circuitry comprises at least one of a touch sensitive display, a keypad, an optical scanner, a biometric reader and a card reader.

6. The locker apparatus of claim 1, wherein each locker comprises a chamber for storing corresponding hand portable electronic device and the locking mechanism is for locking and unlocking the locker to prevent or provide user access to the chamber.

7. The locker apparatus of claim 1, wherein a particular hand portable electronic device is assigned to the user in a database, and identifying the hand portable electronic device for the user comprises accessing the database to identify the particular hand portable electronic device assigned to the user, and the signal transmitted by the transmitter is transmitted to the particular hand portable electronic device assigned to the user.

8. The locker apparatus of claim 1, wherein the user is not associated with any particular hand portable electronic device in a database, and identifying the hand portable electronic device for the user comprises assigning a particular hand portable electronic device to the user, and the signal transmitted by the transmitter is transmitted to the particular hand portable electronic device assigned to the user.

9. A method of controlling a locker apparatus comprising a plurality of lockers, each locker being for storing a hand portable electronic device, each locker comprising a receiver configured to receive at least one of light signals or audio signals from a corresponding hand portable electronic device stored in one of the plurality of lockers and comprising a locking mechanism for locking and unlocking the locker, the method comprising:

in response to input being received identifying a user, identifying a hand portable electronic device stored in a locker of the plurality of lockers for the user;

causing a transmitter to a transmit a signal to the hand portable electronic device to cause the hand portable electronic device to output a signal for opening the locker; and if the signal output by the hand portable electronic device is received by one of the receivers configured to receive at least one of light signals or audio signals, causing the locking mechanism of the locker comprising the receiver that received the signal output by the hand portable electronic device to unlock the locker.

10. The method of claim 9, wherein the signal output by the hand portable electronic device is a light signal output by a display of the hand portable electronic device.

11. The method of claim 9, wherein each locker comprises a housing that is substantially opaque.

12. The method of claim 9, wherein the transmitter is a radio frequency transmitter which transmits a radio frequency signal to the hand portable electronic device.

13. The method of claim 9, wherein the input identifying the user is received via at least one of a touch sensitive display, a keypad, an optical scanner, a biometric reader and a card reader.

14. The method of claim 9, wherein each locker comprises a chamber for storing the corresponding hand portable electronic device and the locking mechanism is for locking and unlocking the locker to prevent or provide user access to the chamber.

15. The method of claim 9, wherein a particular hand portable electronic device is assigned to the user in a database, identifying the hand portable electronic device for the user comprises accessing the database to identify the particular hand portable electronic device assigned to the user, and the signal transmitted by the transmitter is transmitted to the particular hand portable electronic device assigned to the user.

16. The method of claim 9, wherein the user is not associated with any particular hand portable electronic device in a database, and identifying the hand portable electronic device for the user comprises assigning a particular hand portable electronic device to the user, and the signal transmitted by the transmitter is transmitted to the particular hand portable electronic device assigned to the user.

17. A locker apparatus, comprising:

a plurality of lockers, wherein each locker is for storing a hand portable electronic device, and wherein each locker comprises at least one receiver configured to receive at least one of light signals or audio signals from a corresponding hand portable electronic device stored in one of the plurality of lockers and comprises a locking mechanism for locking and unlocking the locker;

user input circuitry configured to receive inputs from a user;

a transmitter;

at least one processor; and memory storing at least one computer program having computer program instructions that, when executed by the at least one processor, cause at least the following to be performed:

in response to input being received at the user input circuitry identifying a user, identifying a hand portable electronic device stored in a locker of the plurality of lockers for the user;

causing the transmitter to a transmit a signal to the hand portable electronic device to cause the hand portable electronic device to output at least one of a light signal or an audio signal for opening the locker; and if the signal output by the hand portable electronic device is received by at least one of the receivers, located in one of the plurality of lockers, causing the locking mechanism of the locker to unlock the locker.

* * * * *